US009985377B2

(12) United States Patent
Peng et al.

(10) Patent No.: US 9,985,377 B2
(45) Date of Patent: May 29, 2018

(54) ELECTRONICAL CONNECTOR WITH TERMINAL SLOTS RECEIVING TERMINALS THEREIN

(71) Applicant: SHENZHEN DEREN ELECTRONIC CO., LTD., Shenzhen (CN)

(72) Inventors: Junlan Peng, Shenzhen (CN); Nanlv Tian, Shenzhen (CN); Zhudong Huo, Shenzhen (CN); Xiaolei Shi, Shenzhen (CN); Weiping Xiao, Shenzhen (CN); Tony Zhu, Shenzhen (CN); Tadashi Kosuga, Shenzhen (CN)

(73) Assignee: SHENZHEN DEREN ELECTRONIC CO., LTD., Shenzhen (CN)

( * ) Notice: Subject to any disclaimer, the term of this patent is extended or adjusted under 35 U.S.C. 154(b) by 0 days. days.

(21) Appl. No.: 15/472,442

(22) Filed: Mar. 29, 2017

(65) Prior Publication Data

US 2018/0115102 A1 Apr. 26, 2018

(30) Foreign Application Priority Data

Oct. 21, 2016 (CN) ..... 2016 2 1147027 U
Nov. 24, 2016 (CN) ..... 2016 2 1279913 U

(51) Int. Cl.

| | |
|---|---|
| ***H01R 24/00*** | (2011.01) |
| ***H01R 13/44*** | (2006.01) |
| ***H01R 13/405*** | (2006.01) |
| ***H01R 13/631*** | (2006.01) |
| ***H01R 13/6582*** | (2011.01) |

(52) U.S. Cl.
CPC ..... *H01R 13/44* (2013.01); *H01R 13/405* (2013.01); *H01R 13/631* (2013.01); *H01R 13/6582* (2013.01)

(58) Field of Classification Search
CPC ..... H01R 23/02; H01R 24/60; H01R 24/62
USPC ..... 439/660, 733.1
See application file for complete search history.

(56) References Cited

U.S. PATENT DOCUMENTS 7,462,071 B1 * 12/2008 Wu ..... H01R 9/032 439/497
2012/0015561 A1 * 1/2012 Tsai ..... H01R 24/60 439/660

* cited by examiner

*Primary Examiner* — Phuong Dinh
(74) *Attorney, Agent, or Firm* — Na Xu; IPro, PLLC

(57) ABSTRACT

An electronical connector includes an insulation body and first and second conductive terminals. The insulation body includes a basal part, a middle part and a front end part defining a socketing space. The insulation body defines first and second terminal slots, with both communicating with the socketing space. The first terminal slot is positioned in the middle part and on an inner surface of a lower wall of the front end part. The second terminal slot is positioned in the middle part and on an inner surface of an upper wall of the front end part. The first and second conductive terminals are individually positioned in the first and second terminal slots. The first and second conductive terminals each include a contact part, a connection part, and a welding part. The contact part is positioned in the socketing space and the welding part protrudes out of the basal part.

19 Claims, 6 Drawing Sheets

ELECTRONICAL CONNECTOR WITH TERMINAL SLOTS RECEIVING TERMINALS THEREIN

The present disclosure claims priority to Chinese Patent Application No. 201621279913.2, filed with the Chinese Patent Office on Nov. 24, 2016, titled "ELECTRONICAL CONNECTOR," which claims priority to Chinese Patent Application No. 201621147027.4, filed with the Chinese Patent Office on Oct. 21, 2016, titled "ELECTRONICAL CONNECTOR," the entire contents of which are incorporated herein by reference.

TECHNICAL FIELD

The present disclosure relates to an electronical connector.

BACKGROUND

Electronical connectors are widely used in various electronic instruments for electronical connection with an external plug so as to transmit audio, video or other data signals.

Currently, the electronical connectors generally include an insulation body and conductive terminals mounted on the insulation body. The insulation body includes a socket space used for accommodating an external plug and terminal slots communicating with the socketing space and configured to accommodating the conductive terminals. The terminal slots are formed by the depression of one outer surface of the insulation body, and communicate with the outside, which facilitates the installation of the conductive terminals from outside of the insulation body. As a result, the outer surface of the insulation body is unsealed, and after the conductive terminals have been assembled, part of the conductive terminals are exposed (as shown in FIG. 1), which easily leads to circuit failure, and then damage the electronic instruments. To prevent the risks caused by the exposure of the conductive terminals, extra parts need to be employed, for example, a plastic sheet is positioned on the outer surface of the insulation body to cover the exposed part of the conductive terminals.

SUMMARY

An embodiment of the present disclosure provides an electronical connector. The electronical connector includes:

an insulation body including a basal part, a middle part, and a front end part; the front end part defining a socketing space; the insulation body defining a first terminal slot and a second terminal slot, and the first terminal slot and the second terminal slot both communicating with the socketing space; the front end part including an upper wall, a lower wall, and two side walls; the first terminal slot positioned in the middle part and on an inner surface of the lower wall of the front end part, and the second terminal slot positioned in the middle part and on an inner surface of the upper wall of the front end part;

a first conductive terminal positioned in the first terminal slot; and a second conductive terminal positioned in the second terminal slot, the first conductive terminal and the second conductive terminal each including a contact part, a connection part, and a welding part, the contact part positioned in the socketing space, and the welding part protruding and extending out of the basal part.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed.

DETAILED DESCRIPTION

For better understanding of the present disclosure of the utility model, detailed description for embodiments of the present disclosure will be given below in conjunction with accompanying drawings.

Figure 1:
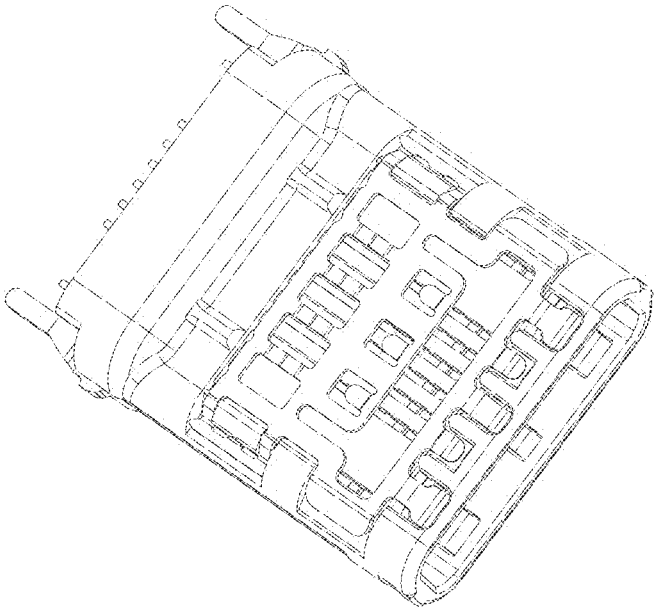
FIG. 1 (Related Art)
FIG. 1 is a perspective view illustrating an electronical connector equipped with conductive terminals in related arts.
Figure 2:
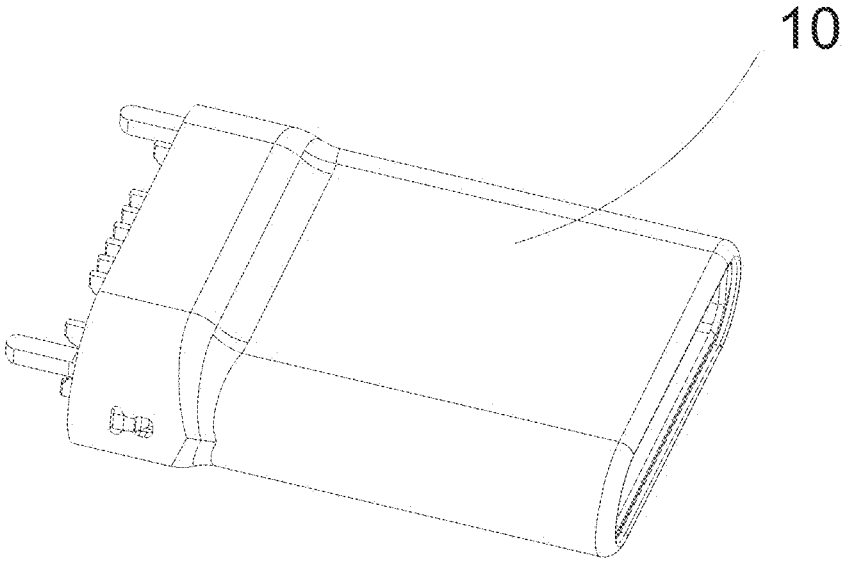
FIG. 2 is a perspective view illustrating an electronical connector in accordance with a first embodiment of the present disclosure.
Figure 3:
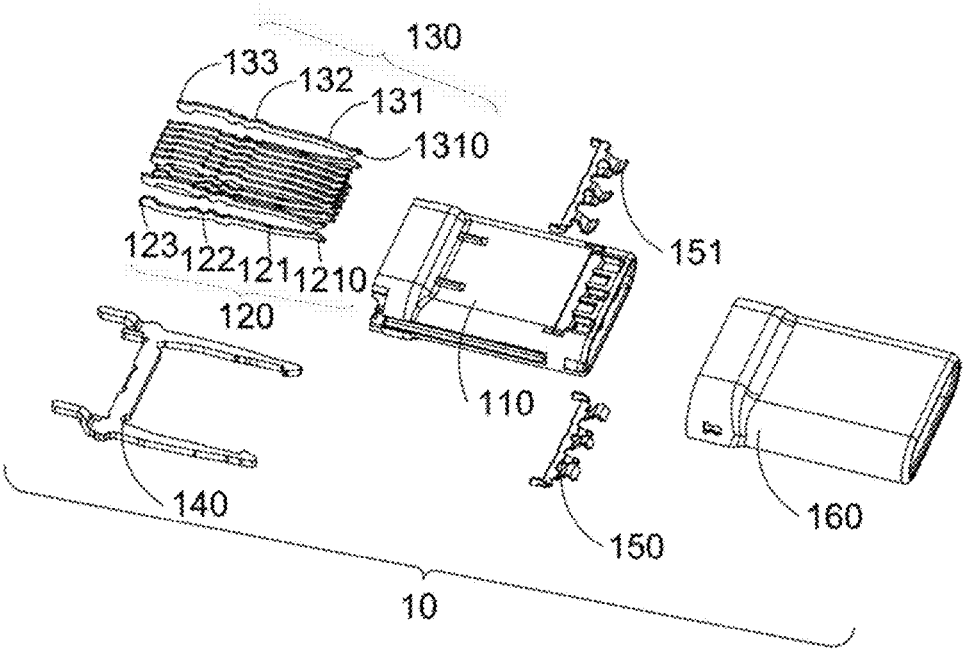
FIG. 3 is an exploded view of the electronical connector of FIG. 2.
Figure 4:
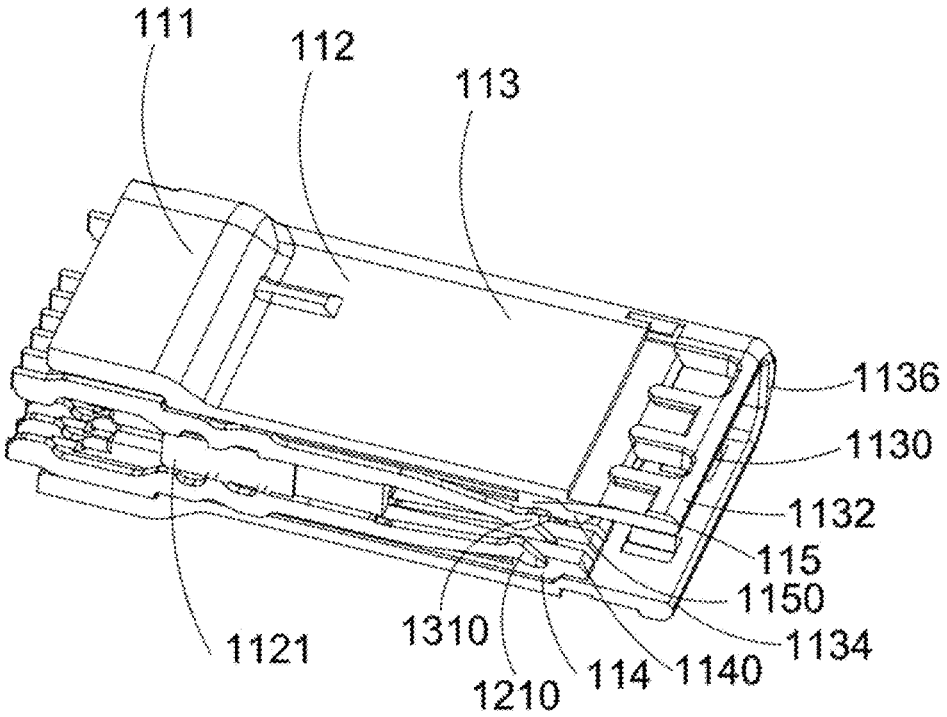
FIG. 4 is a cut-away view illustrating an interior structure of the electronical connector of FIG. 2.

A first embodiment of the present disclosure provides an electronical connector 10, as shown in FIGS. 2, 3 and 4. FIG. 2 is a perspective view of the electronical connector 10, FIG. 3 is an exploded view of the electronical connector 10, and FIG. 4 is a cut-away view illustrating the interior structure of the electronical connector 10.

The electronical connector 10 includes an integratedly formed insulation body 110, a first conductive terminal 120, and a second conductive terminal 130. The insulation body 110 includes a basal part 111, a middle part 112, and a front end part 113; the front end part 113 includes a socketing space 1130; the insulation body 110 includes a first terminal slot 114 and a second terminal slot 115 both communicating with the socketing space 1130. The front end part 113 includes an upper wall 1132, a lower wall 1134, and two side walls 1136, the first terminal slot 114 is positioned in the middle part 112 and on an inner surface of the lower wall 1134 of the front end part 113 of the insulation body 110, and the second terminal slot 115 is positioned in the middle part 112 and on an inner surface of the upper wall 1132 of the front end part 113 of the insulation body 110.

The first conductive terminal 120 is inserted in the first terminal slot 114; the second conductive terminal 130 is inserted in the second terminal slot 115. The first conductive terminal 114 and the second conductive terminal 115 each include a contact part, a connection part, and a welding part; the contact part is positioned in the socketing space 1130, and the welding part protrudes and extends out of the basal part 111, which facilitates the follow-up processing of the electronical connector 10. As shown in FIG. 3, the first conductive terminal 120 includes the contact part 121, the connection part 122, and the welding part 123, and the contact part 121 further includes a terminal head 1210; similarly, the second conductive terminal 130 includes the contact part 131, the connection part 132, and the welding part 133, and the contact part 131 further includes a terminal head 1310.

As shown in FIG. 4, to facilitate the injection molding of the insulation body 110, the front end 1140 of the first terminal slot 114 extends into the socketing space 1130, and the front end 1150 of the second terminal slot 115 extends into the socketing space 1130, thus forming the terminal slots 114, 115 with openings. Specifically, the front end 1140 of the first terminal slot 114 is not sealed by plastics, and the front end 1150 of the second terminal slot 115 is not also sealed by plastics.

Figure 5:
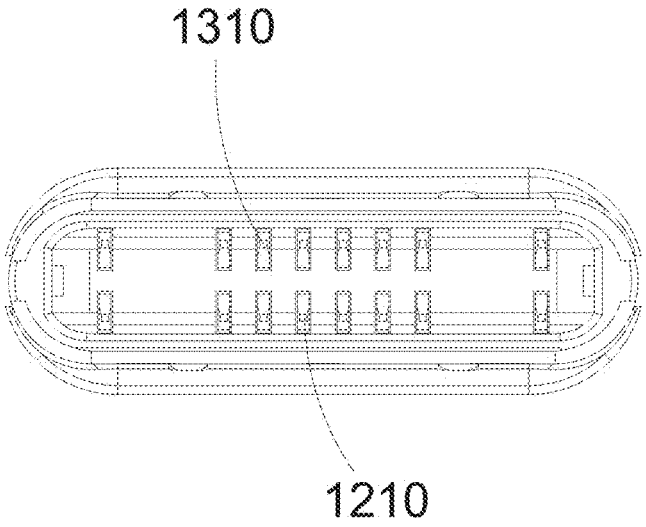
FIG. 5 is a front view of the electronical connector of FIG. 2.

When the first conductive terminal 120 is positioned in the first terminal slot 114, the front end of the contact part 121 of the first conductive terminal 120 is suspended, and when the second conductive terminal 130 is positioned in the second terminal slot 115, the front end of the contact part 131 of the second conductive terminal 130 is suspended. The terminal head 1210 of the first conductive terminal 120 and the terminal head 1310 of the second conductive terminal 130 both extend into the socketing space 1130. To observe the inner side of the insulation body 110 from the socketing space 1130, all the terminal heads 1210, 1310 are exposed, as shown in FIG. 5, which can ensure the connection of the electronical connector 10 and the external plugs is more stable.

Figure 6:
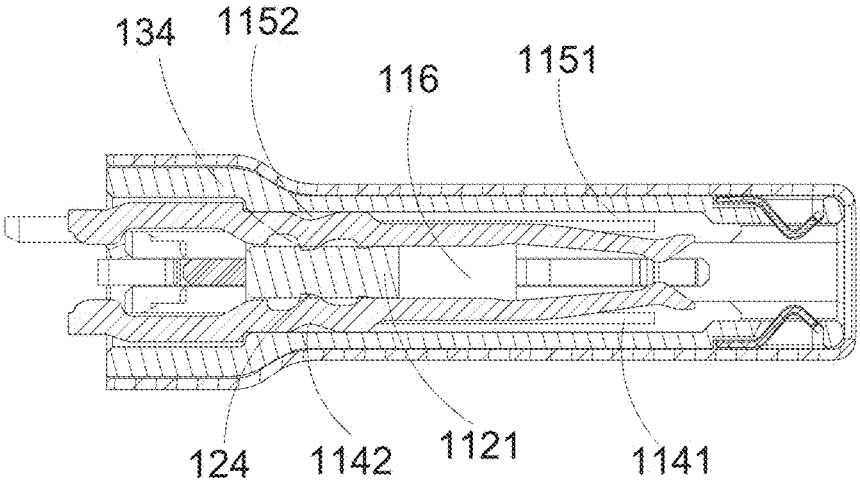
FIG. 6 is a cross-sectional view illustrating an embodiment of an insulation body of the electronical connector of FIG. 2.

As shown in FIG. 6, the middle part 112 of the insulation body 110 includes a first bump 1121; the first terminal slot 114 includes a first front terminal slot 1141 and a first rear terminal slot 1142, the second terminal slot 115 includes a second front terminal slot 1151 and a second rear terminal slot 1152, and the first rear terminal slot 1142 and the second rear terminal slot 1152 are respectively positioned at two sides of the first bump 1121 from the top and down.

The insulation body 110 includes an accommodation terminal slot 116 positioned between the front terminal slot 1151 and the rear terminal slot 1152, part of the connection part 121 of the first conductive terminal 120 and part of the connection part 131 of the second conductive terminal 130 are both positioned in the accommodation terminal slot 116, and the height of the accommodation terminal slot 116 is larger than that of the rear terminal slot 1152, so that, when being assembled, the first and second conductive terminals 120, 130 can be easily inserted in the terminal slots 114, 115 inside the insulation body 110.

Because the connection parts 122, 132 of the first and second conductive terminals 120, 130 are wider than the contact parts 121, 131, the connection parts 122, 132 of the first and second conductive terminals 120, 130 are positioned in the rear terminal slots 1142, 1152 and the accommodation terminal slot 116, and the contact parts 121, 131 are positioned in the front terminal slots 1141, 1151, the widths of the rear terminal slots 1142, 1152 and the accommodation terminal slot 116 are larger than that of the front terminal slots 1141, 1151, so that the first and second conductive terminals 120, 130 are tightly inserted in the first and second terminal slots 114, 115.

The first conductive terminal 120 includes a first clamping point 124, the second conductive terminal 130 include a second clamping point 134, and the first clamping point 124 and the second clamping point 134 clamp the first bump 1121 and are fixed to the first bump 1121, so that the fixation of the first and second conductive terminals 120, 130 and the insulation body 110 are more secure, which is favorable to strengthening the entire structure of the electronical connector 10.

Figure 7:
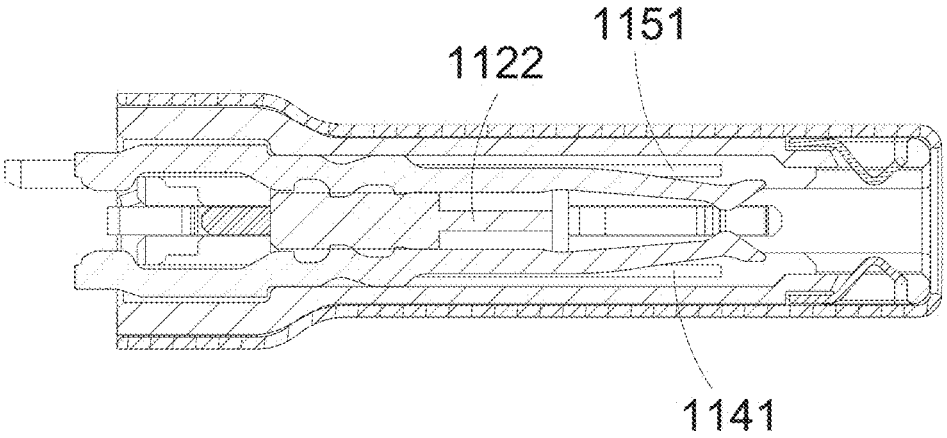
FIG. 7 is a cross-sectional view illustrating another embodiment of the insulation body of the electronical connector of FIG. 2.

As shown in FIG. 7, in another embodiment, the middle part 112 further includes a second bump 1122. The first front terminal slot 1141 and the second front terminal slot 1151 are separated by the second bump 1122, so that, when being assembled, the first and second conductive terminals 120, 130 are more easily inserted in the first and second terminal slots 114, 115 inside the insulation body 110.

Actually, as needed, the first conductive terminal 120, the second conductive terminal 130, the first terminal slot 114, and the second terminal slot 115 can all be multiple in number. A plurality of first terminal slots 114 are positioned side by side, and likewise, a plurality of second terminal slots 115 are positioned side by side; each first terminal slot 114 correspondingly accommodates one first conductive terminal 120, and each second terminal slot 115 correspondingly accommodates one second conductive terminal 130. As a result, a plurality of first conductive terminals 120 is positioned side by side, and a plurality of second conductive terminals 130 is positioned side by side. In this illustrated embodiment, the first terminal slot 114 and the second terminal slot 115 are vertically symmetrical, and the first conductive terminal 120 and the second conductive terminal 130 are also vertically symmetrical. In other embodiments, the first terminal slot 114 and the second terminal slot 115 are not vertically symmetrical.

The insulation body 110 is an integrated structure, which can effectively reduce the risks of disruption of the insulation body 110 after the electronical connector 10 is repeatedly plugged in and pulled out of external sockets or other connectors, so the electronical connector 10 has a more stable structure.

In some embodiments, the electronical connector 10 further includes: a locking element 140, a grounding element 150, and a metal shell 160. The grounding element 150 is fixed on the front end part of the insulation body 110, and includes a ground lug 151 protruding and extending into the socketing space 1130. The locking element 140 is fixed on the two side walls 1136 of the front end part 113. The metal shell 160 receives and is fixed on the insulation body 110. In this way, the electronical connector 10 that can be used independently is formed.

The electronical connector 10 according to the embodiments of the present disclosure includes a first terminal slot 114 and a second terminal slot 115, the first terminal slot 114 is positioned in the middle part 112 and on the inner surface of the lower wall 1134 of the front end part 113 of the insulation body 110, and the second terminal slot 115 is positioned in the middle part 112 and on the inner surface of the upper wall 1132 of the front end part 113 of the insulation body 110; the first conductive terminal 120 and the second conductive terminal 130 are inserted in the first terminal slot 114 and the second terminal slot 115, respectively, as a result, after being assembled, the first and second conductive terminals 120, 130 are not exposed when being observed whether from the top down or from the bottom up, and no extra parts are involved, thus preventing the hidden risks caused by the exposure of the first and second conductive terminals 120, 130.

Figure 8:
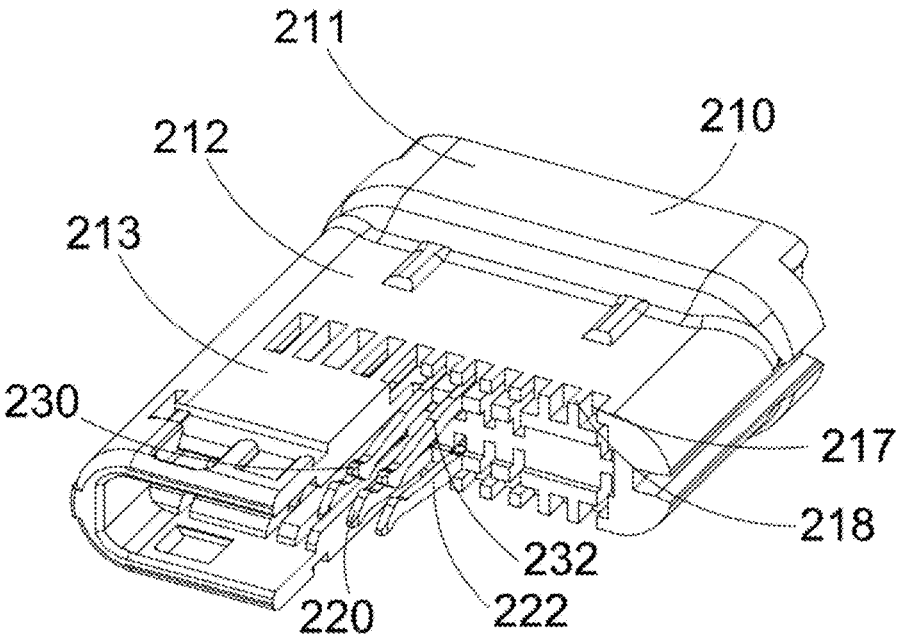
FIG. 8 is a perspective view illustrating an interior structure of an electronical connector in accordance with a second embodiment of the present disclosure.

FIG. 8 is a perspective view illustrating the interior structure of an electronical connector in a second embodiment of the present disclosure. Different from the electronical connector 10 of the first embodiment as shown in FIGS. 2-7, the electronical connector of the second embodiment includes non-through slotted holes 217 on at least one surface of upper and lower surfaces of the insulation body 210. The slotted holes 217 are sunken along a direction from the one surface to the socketing space, a barrier 218 is positioned between two adjacent slotted holes 217, and the first conductive terminal 220 and the second conductive terminal 230 are positioned above and/or below the barrier 218. The slotted holes 217 are positioned on the surface of the insulation body 210, and are configured to cooperate with the die core in the mold to clamp the PIN needles (terminal needles), thereby preventing the deformation and deviation of the PIN needles, and ensuring the first and second terminal slots 214, 215 do not deform in the molding process of the insulation body 210.

In this embodiment, both the upper surface and the lower surface of the insulation body 210 include the slotted holes 217 and barriers 218, at least part of the connection part 222 of the first conductive terminal 220 is positioned above the barrier 218 on the lower surface of the insulation body 210, and at least part of the connection part 232 of the second conductive terminal 230 is positioned below the barrier 218 on the upper surface of the insulation body 210.

In the molding process of the insulation body 210, because the PIN needles transversely penetrate the inside of the insulation body 210, that is, penetrate from the basal part 211 to the front end part 213, the slotted holes 217 can be positioned in the front end part 213, or part of the slotted holes 217 are positioned in the front end part 213, and the other part of the slotted holes 217 are positioned in the middle part 212. The slotted holes 217 are square in shape, which is favorable to increasing the clamping force of the adjacent two slotted holes 217 acting on the PIN needles, and at least one row of the slotted holes 217 are arranged.

Figure 9:
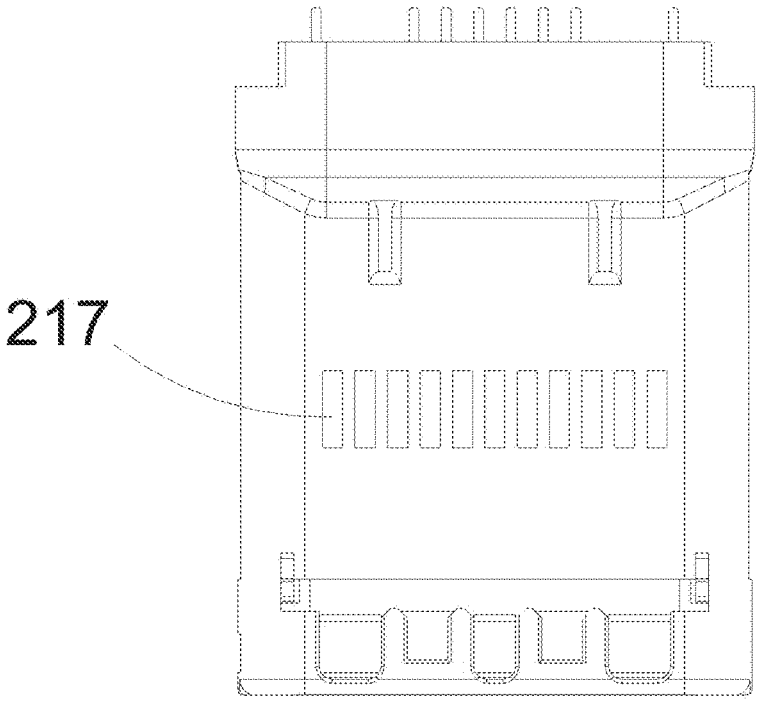
FIG. 9 is a top view of an insulation body of the electronical connector of FIG. 8.
Figure 10:
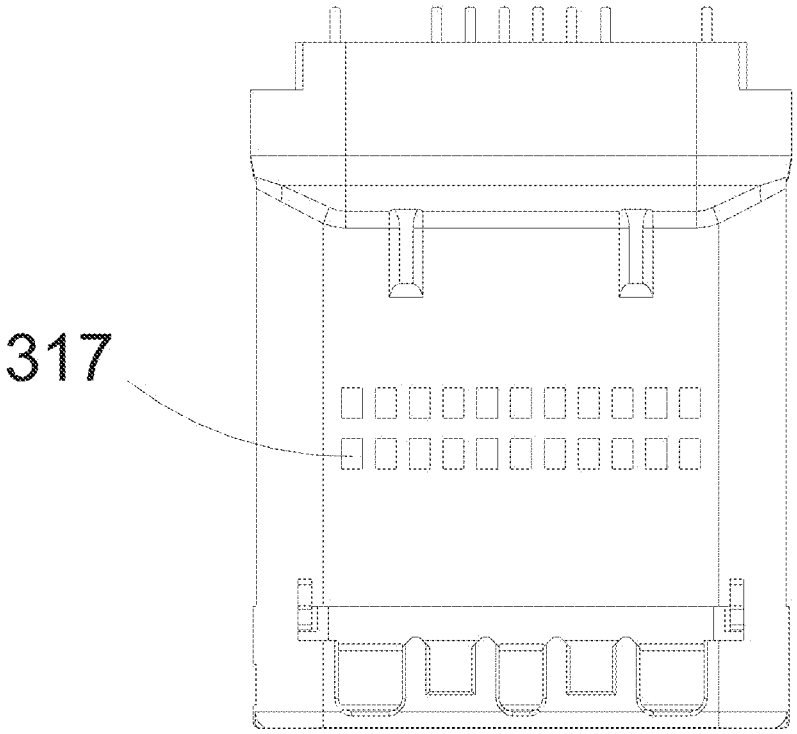
FIG. 10 is a top view of an insulation body of an electronical connector in accordance with a third embodiment of the present disclosure.

FIG. 9 is a top view of the insulation body 210 of the electronical connector according to the second embodiment of the present disclosure; and FIG. 10 is a top view of an insulation body of an electronical connector according to a third embodiment of the present disclosure. Different from that in the second embodiment, the upper and lower surfaces of the insulation body of the electronical connector in the third embodiment both include the slotted holes 317 and barriers, so as to increase the clamping force of the two adjacent slotted holes 317 acting on the PIN needles. In other embodiments, multiple rows of the slotted holes 317 are positioned on the upper and lower surfaces of the insulation body, or multiple rows of the slotted holes 317 are only positioned on the upper or lower surface of the insulation body.

In the embodiments of the present disclosure, non-through slotted holes are positioned on at least one surface of the upper and lower surfaces of the insulation body, which can ensure the terminal slots do not deform in the molding process of the insulation body; the barriers are positioned between two adjacent slotted holes, and the conductive terminals are positioned above and/or below the barriers, as a result, after being assembled, the conductive terminals are not exposed when being observed whether from the top down or from the bottom up, and no extra parts are involved, thus preventing the hidden risks caused by the exposure of the conductive terminals.

Finally it shall be noted that, the above embodiments are only used to describe but not to limit the technical solutions of the present disclosure; and within the concept of the present disclosure, technical features of the above embodiments or different embodiments may also be combined with each other, the steps may be implemented in an arbitrary order, and many other variations in different aspects of the present disclosure described above are possible although, for purpose of simplicity, they are not provided in the details. Although the present disclosure has been detailed with reference to the above embodiments, those of ordinary skill in the art shall appreciate that modifications can still be made to the technical solutions disclosed in the above embodiments or equivalent substations may be made to some of the technical features, and the corresponding technical solutions will not depart from the scope of the present disclosure due to such modifications or substations.

What is claimed is:

1. An electronical connector, comprising:

an insulation body comprising a basal part, a middle part, and a front end part; the front end part defining a socketing space; the insulation body defining a first terminal slot and a second terminal slot, and the first terminal slot and the second terminal slot both communicating with the socketing space; the front end part comprising an upper wall, a lower wall, and two side walls; the first terminal slot positioned in the middle part and on an inner surface of the lower wall of the front end part, and the second terminal slot positioned in the middle part and on an inner surface of the upper wall of the front end part;

a first conductive terminal positioned in the first terminal slot; and a second conductive terminal positioned in the second terminal slot, the first conductive terminal and the second conductive terminal each comprising a contact part, a connection part, and a welding part, the contact part positioned in the socketing space, and the welding part protruding and extending out of the basal part;

wherein a number of non-through slotted holes are defined on at least one surface of upper and lower surfaces of the insulation body, the slotted holes are sunken along a direction from the one surface to the socketing space, a barrier is positioned between two adjacent slotted holes, and the first conductive terminal and the second conductive terminal are positioned above and/or below the barrier.

2. The electronical connector according to claim 1, wherein the first terminal slot and the second terminal slot each comprise a front end extending into the socketing space.

3. The electronical connector according to claim 2, wherein the first conductive terminal and the second conductive terminal each comprise a front end extending into the socketing space.

4. The electronical connector according to claim 3, wherein, the middle part of the insulation body comprises a first bump; and the first terminal slot and the second terminal slot each comprise a front terminal slot and a rear terminal slot, and the rear terminal slot of the first terminal slot and the rear terminal slot of the second terminal slot are respectively positioned at two sides of the first bump.

5. The electronical connector according to claim 4, wherein, the insulation body comprises an accommodation terminal slot positioned between the front terminal slot and the rear terminal slot, part of the connection part of the first conductive terminal and part of the connection part of the second conductive terminal are both positioned in the accommodation terminal slot, and a height of the accommodation terminal slot is larger than a height of the rear terminal slot.

6. The electronical connector according to claim 5, wherein widths of the rear terminal slot and the accommodation terminal slot are larger a width of the front terminal slot, the connection part of each of the first and second conductive terminals is wider than the contact part of each of the first and second conductive terminals, the connection part of each of the first and second conductive terminals is positioned in the rear terminal slot and the accommodation terminal slot, and the contact part of each of the first and second conductive terminals is positioned in the front terminal slot.

7. The electronical connector according to claim 4, wherein the first conductive terminal and the second conductive terminal each comprise a clamping point, and the clamping point clamps the first bump.

8. The electronical connector according to claim 1, further comprising:

a grounding element comprising a ground lug protruding and extending into the socketing space, the grounding element fixed on the front end part of the insulation body;

a locking element fixed on the two side walls of the front end part; and a metal shell fixed on the insulation body.

9. The electronical connector according to claim 1, wherein the upper and lower surfaces of the insulation body both comprise the slotted holes and barriers, at least part of the connection part of the first conductive terminal is positioned above the barrier on the lower surface of the insulation body, and at least part of the connection part of the second conductive terminal is positioned below the barrier on the upper surface of the insulation body.

10. The electronical connector according to claim 9, wherein, the slotted holes are positioned in the front end part, or part of the slotted holes are positioned in the front end part, and the other part of the slotted holes are positioned in the middle part; and the slotted holes are square in shape, and at least one row of the slotted holes is arranged.

11. The electronical connector according to claim 4, wherein the middle part comprises a second bump, and the front terminal slot of the first terminal slot and the front terminal slot of the second terminal slot are separated by the second bump.

12. An electronical connector, comprising:

an insulation body comprising a basal part, a middle part, a front end part and accommodation terminal slot; the front end part defining a socketing space; the insulation body defining a first terminal slot and a second terminal slot, and the first terminal slot and the second terminal slot both communicating with the socketing space;

the front end part comprising an upper wall, a lower wall, and two side walls; the first terminal slot positioned in the middle part and on an inner surface of the lower wall of the front end part, and the second terminal slot positioned in the middle part and on an inner surface of the upper wall of the front end part;

the first terminal slot and the second terminal slot each comprise a front terminal slot and a rear terminal slot;

the accommodation terminal slot positioned between the front terminal slot and the rear terminal slot, part of the connection part of the first conductive terminal and part of the connection part of the second conductive terminal are both positioned in the accommodation terminal slot, and a height of the accommodation terminal slot is larger than a height of the rear terminal slot.

13. The electronical connector according to claim 12, wherein the first terminal slot and the second terminal slot each comprise a front end extending into the socketing space.

14. The electronical connector according to claim 12, wherein the first conductive terminal and the second conductive terminal each comprise a front end extending into the socketing space.

15. The electronical connector according to claim 12, wherein the insulation body comprises an accommodation terminal slot positioned between the front terminal slot and the rear terminal slot, part of the connection part of the first conductive terminal and part of the connection part of the second conductive terminal are both positioned in the accommodation terminal slot, and a height of the accommodation terminal slot is larger than a height of the rear terminal slot.

16. The electronical connector according to claim 15, wherein widths of the rear terminal slot and the accommodation terminal slot are larger a width of the front terminal slot, the connection part of each of the first and second conductive terminals is wider than the contact part of each of the first and second conductive terminals, the connection part of each of the first and second conductive terminals is positioned in the rear terminal slot and the accommodation terminal slot, and the contact part of each of the first and second conductive terminals is positioned in the front terminal slot.

17. The electronical connector according to claim 12, wherein the first conductive terminal and the second conductive terminal each comprise a clamping point, and the clamping point clamps the first bump.

18. The electronical connector according to claim 12, wherein the middle part comprises a second bump, and the front terminal slot of the first terminal slot and the front terminal slot of the second terminal slot are separated by the second bump.

19. An electronical connector, comprising:

an insulation body comprising a basal part, a middle part, and a front end part; the front end part defining a socketing space; the insulation body defining a first terminal slot and a second terminal slot, and the first terminal slot and the second terminal slot both communicating with the socketing space; the front end part comprising an upper wall, a lower wall, and two side walls; the first terminal slot positioned in the middle part and on an inner surface of the lower wall of the front end part, and the second terminal slot positioned in the middle part and on an inner surface of the upper wall of the front end part;

a first conductive terminal positioned in the first terminal slot;

a second conductive terminal positioned in the second terminal slot, the first conductive terminal and the second conductive terminal each comprising a contact part, a connection part, and a welding part, the contact part positioned in the socketing space, and the welding part protruding and extending out of the basal part;

a grounding element comprising a ground lug protruding and extending into the socketing space, the grounding element fixed on the front end part of the insulation body;

a locking element fixed on the two side walls of the front end part; and a metal shell fixed on the insulation body.

* * * * *